US005391097A

United States Patent [19]

Kerul

[11] Patent Number: 5,391,097

[45] Date of Patent: Feb. 21, 1995

[54] LOW INSERTION FORCE TERMINAL ASSEMBLY

[75] Inventor: Joseph A. Kerul, Girard, Ohio

[73] Assignee: Interlock Corporation, Westland, Mich.

[21] Appl. No.: 142,935

[22] Filed: Oct. 29, 1993

[51] Int. Cl.[6] ..... H01R 13/05

[52] U.S. Cl. ..... 439/825

[58] Field of Search ..... 439/823, 825, 826, 827

[56] References Cited

U.S. PATENT DOCUMENTS

| | | | |
|---|---|---|---|
| 1,334,084 | 3/1920 | Dorsey | 439/825 |
| 3,323,100 | 5/1967 | Book | 439/825 |
| 4,374,607 | 2/1983 | Bright et al. | 439/825 |
| 4,526,429 | 7/1985 | Kirkman | 439/825 X |
| 5,269,711 | 12/1993 | Wright | 439/825 |

*Primary Examiner*—Kenneth J. Ramsey

*Attorney, Agent, or Firm*—Harness, Dickey & Pierce

[57] ABSTRACT

A terminal assembly having a male member and a female member. The male and female members are formed with cooperating surfaces such that a greater force is required to disengage the members from one another than to engage them together.

7 Claims, 2 Drawing Sheets

LOW INSERTION FORCE TERMINAL ASSEMBLY

BACKGROUND AND SUMMARY OF THE INVENTION

This invention generally relates to an electrical terminal assembly and, more particularly, to a terminal assembly having mated male and female members which are easier, in terms of the required amount of force, to engage than to disengage.

Terminal assemblies are used in a wide variety of products having electrical components. These products range from simple electrical items, such as a lamp, to those with highly sophisticated electrical systems, such as an automobile.

One variety of terminal assembly uses a male member and a female member which are mated together along a mating axis. Typically, the members or the terminals, are formed by bending a stamped piece of conductive material into the desired configuration. When formed by bending, common terminal materials include nickel plated tin, stainless steel and beryllium copper. As an alternative, the female terminal can be formed by machining cast pieces of conductive material. When formed by casting and machining, one common terminal material is aluminum.

While mated terminals generally work well for their intended purposes, a number of problems can arise when the terminals are repeatedly engaged and disengaged from each other. One problem is that the terminals may become deformed. Deformation is particularly a problem when the male terminal is withdrawn from the female terminal at an angle with respect to the mating axis. Repeated insertion and withdrawal can also result in a decreased contact normal force, a loss in electrical interface integrity, material fatigue, and a decrease in the amount of force required for disengagement of the terminals. This latter problem allows the terminal assembly to be more susceptible to inadvertent disengagement.

To maintain a high resistance to withdrawal or disengagement, one solution is to create a "tighter fit" between the terminals and another is to use less resilient materials in forming the terminals. However, these solutions result in an increase in the force needed to insert the male terminal into the female terminal. Unfortunately, the requirement of a high insertion force is undesirable from a product assembly standpoint.

With the above limitations in mind, it is object of the present invention to provide a terminal assembly which requires a different amount of force for engagement than for disengagement. In particular, it is an object of this invention to provide a terminal assembly that can be easily engaged, but which is significantly harder to disengage.

Still another object of this invention is to provide a terminal assembly that maintains a high contact normal force between the terminals even after repeated engagement and disengagement of the terminals. A related object is therefore sustaining the electrical interface integrity between the terminals after repeated engagement and disengagement.

A further object of this invention is to provide a terminal assembly which resists deformation of the individual terminals as a result of them being pulled apart or disengaged at an angle relative to each other or off line of the mating axis.

In achieving these an other objects, the present invention provides a terminal assembly which has male and female members that are adapted for mated engagement along a mating axis. The lead end of the male member is inserted into the female member of the assembly and a first ramping surface, which is inclined proceeding away from the lead end, is defined on the male member at a predetermined ramp angle with respect to the mating axis. A second ramping surface, adjacent to the first, is formed on the male member so as to define another ramp angle with respect to the mating axis. The second ramping surface, however, is declined in a direction proceeding away from the lead end. The male member is longitudinally divided in half so that the first and second ramping surfaces are both formed on a pair of resilient arms. The arms operate as a means for biasing the first and second ramping surfaces outward, from the mating axis, and allow the male member to be repeatedly inserted and withdrawn without deformation of its overall shape. To require different insertion and withdrawal forces, the ramp angle defined by the first ramping surface is less than the ramp angle defined by the second ramping surface.

When the male and female members are being engaged with each other, the first ramping surface contacts a correspondingly angled surface on the female member. The inherent biasing of the resilient arms cooperate with the shallow first ramp angle to provide a minimum amount of resistance to engagement. However, during withdrawal of the male member from female member, the biasing of the arms cooperates with the steeper ramp angle of the second ramping surface, and a correspondingly angled surface on the female member, to provide a significantly greater amount of resistance.

By constructing the male terminal with a pair of resilient arms, it is possible for the terminals of the assembly to be angularly disengaged from each other without resulting in the terminals becoming deformed as a result of the off-line withdrawal. Similarly, the bias of the arms ensures that a high contact normal force is maintained thereby sustaining the electrical interface integrity of the mated assembly.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENT

Figure 3:
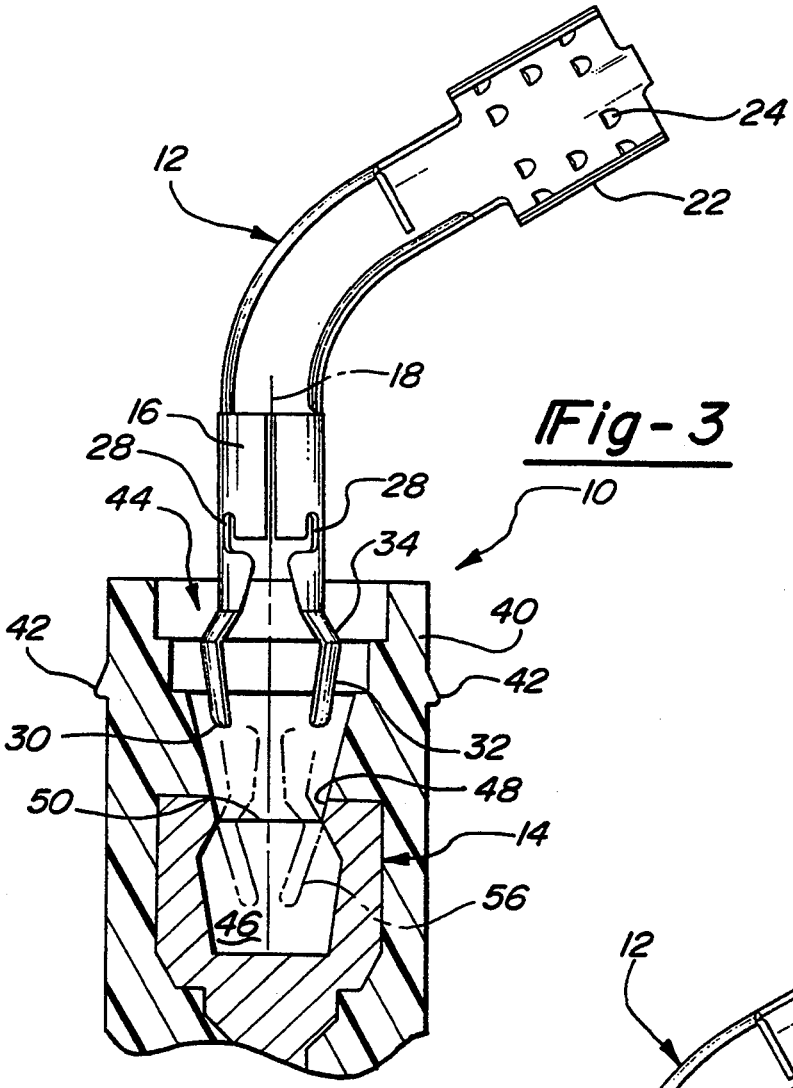
FIG. 3 is a partial sectional view illustrating a male member partially engaged with a female member of a terminal assembly incorporating the principles of the present invention.
Figure 4:
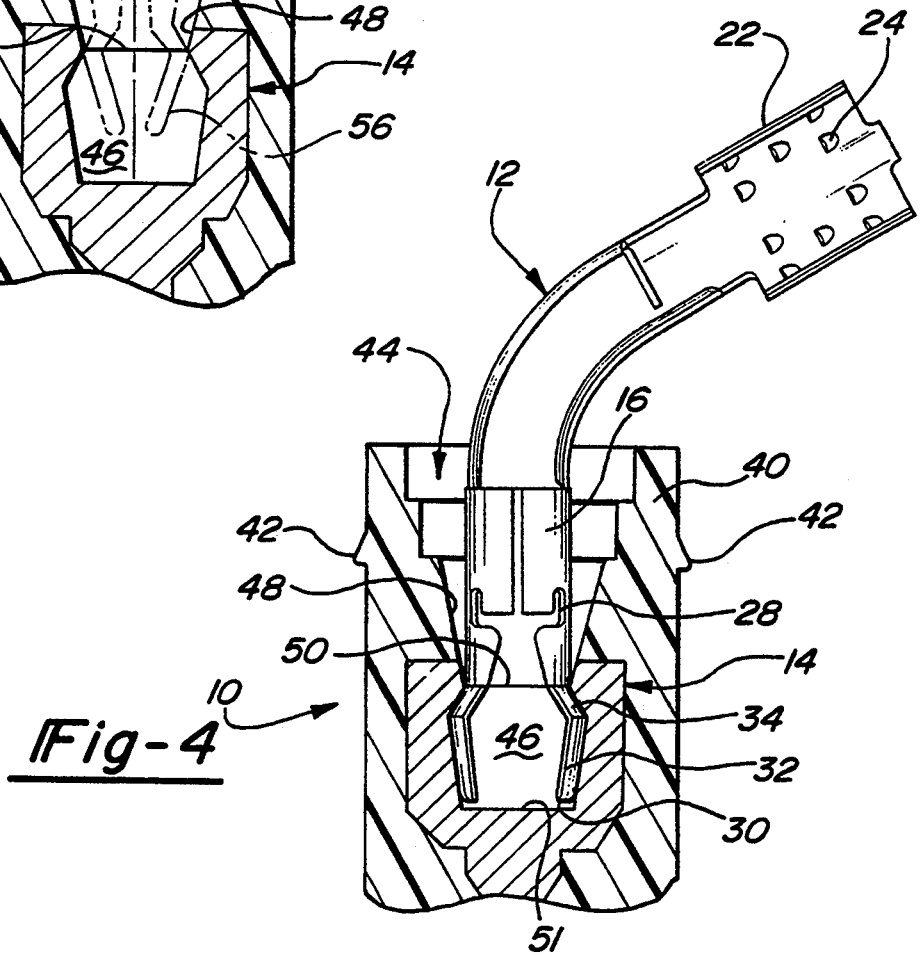
FIG. 4 is a partial sectional view illustrating a male member fully engaged with a female member of a terminal assembly according to the principles of the present invention.

Referring now to the drawings, a terminal assembly incorporating the principles of the present invention is illustrated in FIGS. 3 and 4 and generally designated at 10. The assembly principally includes a male terminal or member 12 and a female terminal or member 14.

The particular terminal assembly 10 illustrated in the Figures is intended for use in a distributorless ignition system of a motor vehicle. While shown in an embodiment specifically intended for such a system, it will be appreciated from the discussion which follows that the terminal assembly 10 will have equal utility in numerous other applications, particularly where a pair of electrical members are mounted together through a male and female engagement.

Figure 1:
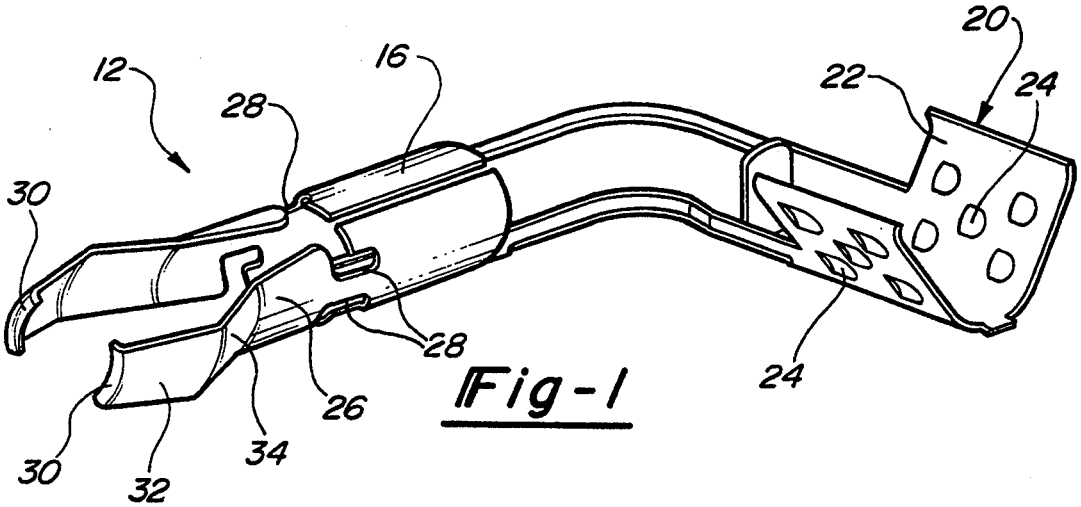
FIG. 1 is a perspective view of a male member terminal assembly incorporating the principles of the present invention.
Figure 2:
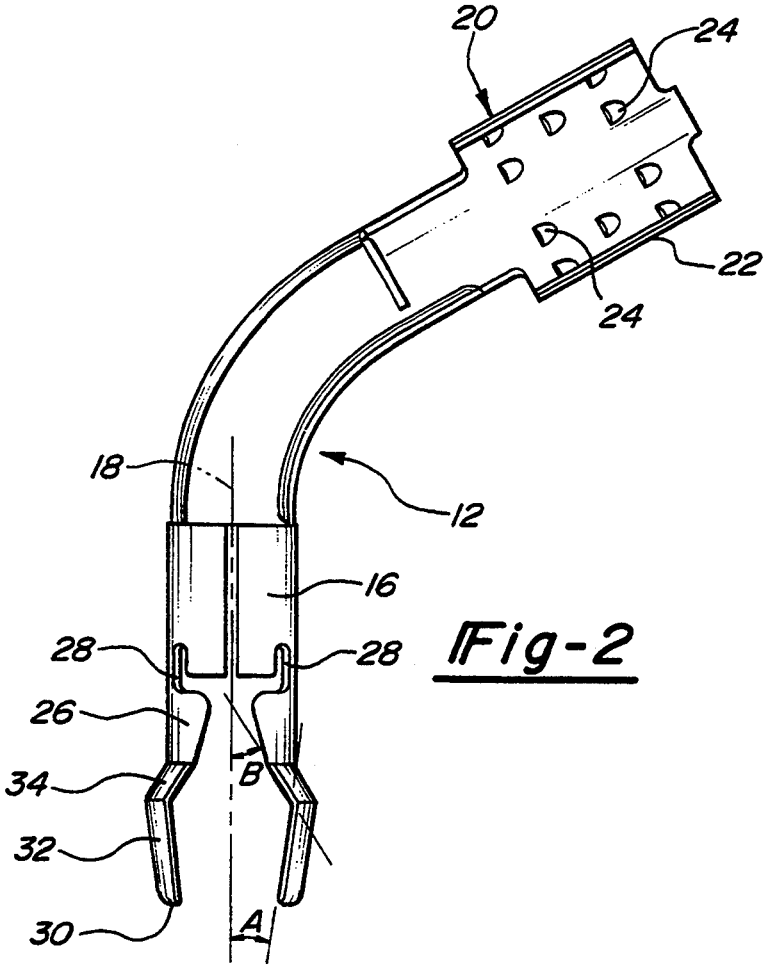
FIG. 2 is a top plan view of a portion of the male member shown in FIG. 1.

Referring now to FIG. 1, a male terminal 12 is illustrated therein as being formed from an electrically conducted material which is initially stamped from plate stock and subsequently bent into the illustrated configuration. The preferred materials for the male terminal 12 are any of the commonly used materials including stainless steel, beryllium copper, or nickel plated tin. Also, because the terminal 12 does not contain or require intricate or small detailing such as sharp bends of its various portions, as will be seen by the following discussion, it is also possible for the terminal 12 to be cast from conductive plastic. The male terminal 12 includes a generally cylindrical body or barrel 16 which is substantially coaxial with a mating axis 18. The mating axis 18 is the axis along which the male terminal 12 is moved to engage it with the female terminal 14.

Integrally extending from the rearward end of the barrel 16 is a grip 20. The grip 20 includes a pair of transverse flanges 22, provided with rasps 24, and is adapted to engage and secure the male terminal 12 to an ignition or other wire (not shown). The rasps 24 engage the insulation surrounding the ignition wire as the flanges 22 are crimped thereover and resist having the wire inadvertently pulled and disengaged from the male terminal 12. The conductive portions of the ignition wire are held in electrically conductive engagement with the male terminal 12 through soldering, further crimping or another common engagement methods. The grip 20 can additionally be oriented so that it is aligned with or angularly offset from the mating axis 18. This orientation will depend on the particular requirements of the application in which the assembly 10 is to be used.

The forward end of the male terminal 12 is defined by a pair of longitudinally extending and radially spaced apart arms 26. The arms 16 are integrally formed with the barrel 16 and include cut-outs 28 adjacent to the point where the arms 26 merge with the barrel 16. The cut-outs 26 provide each arm 26 with a hinge point that allows the arms 26 to deflect inwardly toward the mating axis 18 in response to engagement of the male terminal 12 with the female terminal 14.

Each arm 26 further includes a lead end 30, which is the first portion of the male terminal 12 to be inserted into the female terminal 14. Proceeding from the lead end 30 toward the barrel 16, the arms 26 include a first or shallow ramping surface 32 and a second or steep ramping surface 34. The first ramping surface 32 generally defines a first ramp angle (A) with respect to the mating axis 18. The first ramp angle (A) is less than a second ramp angle (B) similarly defined by the second ramping surface 34 with respect to the mating axis 18. While the purpose of the ramping surfaces 32 and 34 and their respective ramp angles (A) and (B) will become more apparent from the discussion which follows, it can also be seen that both surfaces 32 and 34 are laterally or generally curved about the mating axis 18 so that if they were extended, they would define conical surfaces.

As seen in FIGS. 3 and 4, the female terminal 14 of the present embodiment is enclosed within an insulative tower 40. The tower 40 may be provided with a boot seal lip 42 on an exterior surface which will engage and retain an insulative boot (not shown) covering the male terminal 12. The insulative tower 40 and boot (not shown) prevent moisture, dirt and other foreign objects from entering the female terminal 14 and denigrating the electrical contact between the male 12 and female terminals 14. In the illustrated embodiment, the female terminal 14 is constructed from cast aluminum which is further machined into the desired configuration. Additionally, the female terminal 14 could also be cast from conductive plastic.

An insertion opening 44, through which the male terminal 12 is inserted, is defined by a series of annular and conical portions of the tower 40 and the female terminal 14. The female terminal 14 also includes portions which define a receiving cavity 46 into which the first and second ramping surfaces 32 and 34 on the arms 26 of the male terminal 12 are received when the male and female terminals 12 and 14 are fully engaged with one another. The insertion opening 44 of the female terminal is generally defined by a guide or entrance surface 48 which is inclined so that it generally angularly corresponds with the first ramping surface 32 and the first ramp angle 36 of the male terminal 12. The guide surface 48 therefore narrows, as it approaches the receiving cavity 46, defining a neck portion 50 immediately adjacent to the receiving cavity.

The receiving cavity 46 itself is defined by an end wall 51 and by a pair of substantially conical surfaces, herein referred to as a contact surface 52 and an exit or back ramp surface 54, that cooperate to define a seat for the first and second ramped surfaces 32 and 34. These surfaces 52 and 54 respectively angularly correspond in general shape to the first ramping surface 32 (and first ramp angle (A)) and the second ramping surface 34 (and second ramp angle (B)). For reasons which will become apparent from the discussion which follows, the axial length of the receiving cavity 46 is greater than the axial length defined by the first and second ramping surfaces 32 and 34 of the male terminal 12 as seen in FIG. 4. The radial dimensions of the contact surface 52 and the back ramp surface 54, however, are slightly less than the radial dimensions of the first and second ramping surfaces 32 and 34 in their undeflected state prior to engagement.

To engage the male and female terminals 12 and 14, the male terminal 12 is positioned and moved along the mating axis 18 until its lead ends 30 contact the guide surface 48 of the female terminal 14. Continued insertion of the male terminal 12 causes the arms 26 to deflect, generally at the hinge points defined by the cut-outs 28, toward each other and the mating axis 18 allowing the first ramping surfaces 32 to contact the guide surface 48. The shallow ramp angle (A), the resiliency of the arms 26 and the biasing of the arms 26 cooperate to provide only a mild or slight amount of resistance to insertion and engagement. Further insertion of the male terminal 12 causes the deflection of the arms 26 to continue until the radial-most portion of the first ramping surface 32 is at the neck portion 50 of the female terminal 14. This is designated in phantom at 56 in FIG. 3. The arms 26 naturally bias outwardly upon further insertion of the male terminal 12 until the arms 26 are located within the receiving cavity 46 with the first and second ramping surfaces 32 and 34 generally seated within the conical surfaces 52 and 54. The difference in axial length between the receiving cavity 46 and the corresponding portion of the male terminal 12 allow the male terminal 12 to be over-inserted into the receiving cavity 46 until the lead ends 30 contact the end wall 51. The angles formed by the first ramping surface 32 and the contact surface 52, along with the biasing of the arms 26, cause the male terminal 12 to naturally "back up" or self seat itself within the receiving cavity 46 until the second ramping surface 34 contacts and engages the back ramp surface 54. In this position, the male terminal 12 is fully seated within the female terminal 14. The slightly smaller radial dimensions of the contact surface 52 and back ramp surface 54 ensure that the bias of the arms 26 provides a controlled high contact normal force between the male terminal 12 and female terminal 14 and that the integrity of the electrical interface is sustained.

As mentioned above, the resiliency and biasing of the arms 26 cooperates with the shallow ramp angle (A) of the first ramping surface 32 so that the resistance to insertion is relatively low. This facilitates product assembly. Several other features assist in providing a low insertion force. One such feature is that the arms 26 have a generous axial length. In the illustrated embodiment, the overall length of the arms 26 is shown as being at least twice as long as the axial length of the first ramping surface 32 and four times as long as the axial length of the second ramping surface 34. Obviously, the specific axial length of the arms 26 and the first ramping surfaces 32, as well as the steepness of the first ramp angle (A), can be varied to provide the amount of insertion resistance dictated by the design criteria for the particular application of the terminal assembly 10.

The above is also true with respect to the force required to disengage the terminal assembly 10. The steeper angle defined by the second ramp angle (B) cooperates with the outward bias of the arms 26 and the back ramp surface 54 to provide for an increased resistance to withdraw of the male terminal 12 from the female terminal 14. Thus, if desired, the specific parameters of the terminal assembly 10, and in particular the ramp angles (A) and (B), can be varied so that specific engagement and disengagement forces are necessary with the assembly 10. For example, a two pound force could be required for engagement while a twenty pound force could be required for disengagement of the terminals 12 and 14.

Obviously, the increased withdrawal resistance has significant benefits. One benefit is that it provides assurance that the male and female terminals 12 and 14 are fully and properly engaged with each other. Another benefit is that inadvertent disengagement of the terminals 12 and 14 is better resisted. Still another benefit is that product assembly is made easier.

While the above description constitutes the preferred embodiments of the present invention, it will appreciated that the invention is susceptible to modification, variation and change without departing from the proper scope and fair meaning of the accompanying claims.

I claim:

1. A terminal assembly comprising:

a male member;

a female member adapted to engage said male member along a mating axis;

said male member including mounting means, a body portion and a contact portion, said mounting means extending from said body portion for mounting said male member to a wire lead, said contact portion extending from said body portion and having a lead end and a first ramp surface adjacent to said lead end, said first ramp surface generally defining an incline proceeding from said lead end at a first ramp angle with respect to said mating axis, a second ramp surface located between said first ramp surface and said mounting means, said second ramp surface defining a decline proceeding from said lead end at a second ramp angle with respect to said mating axis, said second ramp angle being greater than said first ramp angle, said male member also including biasing means for biasing said first and second ramp surfaces outward from said mating axis and into engagement with said female member; and said female member including portions defining an insertion opening at one end thereof and a receiving cavity for receiving at least a portion of said male member therein, said portions defining said opening including an entrance ramp surface generally angularly corresponding to said first ramp surface and said first ramp angle of said male member, said entrance ramp surface cooperating with said first ramp surface and said biasing means to provide a predetermined amount of resistance to insertion of said male member into said female member, said portions defining said receiving cavity including an exit ramp surface generally angularly corresponding to said second ramp surface and said second ramp angle of said male member, said exit ramp surface cooperating with said second ramp surface and said biasing means to provide a predetermined amount of resistance to withdrawal of said male member from said female member, said predetermined amount of resistance to withdrawal being greater than said predetermined amount resistance to insertion.

2. A terminal assembly as set forth in claim 1 wherein said receiving cavity has a predetermined axial length, said first and second ramping surfaces generally defining an axial length being less than said predetermined axial length and permitting said male member to be inserted into said female member into an over-inserted position.

3. A terminal assembly as set forth in claim 2 wherein said biasing means and said receiving cavity cooperate to provide for self-seating of said male member from said over-inserted position to a position where said first and second ramping surfaces contact said female member.

4. A terminal assembly as set forth in claim 1 wherein said insertion opening narrows proceeding toward said receiving cavity and defines a necked area of reduced diameter immediately proceeding said receiving cavity.

5. A terminal assembly as set forth in claim 1 wherein said portions defining said receiving cavity further includes a contact surface generally angularly corresponding to said first ramp surface and said first ramp angle of said male member, said contact surface and said exit ramp surface respectively electrically contacting said first and second ramp surfaces when said male member is received within said female member.

6. A terminal assembly as set forth in claim 1 wherein said contact portion is formed by a pair of longitudinal arms, said first and second ramp surfaces being formed on said arms.

7. A terminal assembly as set forth in claim 6 wherein said arms are integrally formed with said body, cut-out portions being defined at the merger of said arms and said body and enabling resilient deflection of said arms.

* * * * *